US009177469B2

(12) United States Patent
Kwong

(10) Patent No.: US 9,177,469 B2
(45) Date of Patent: Nov. 3, 2015

(54) METHOD AND APPARATUS FOR COUNTING THE BIDIRECTIONAL PASSAGE OF VEHICLES IN A WIRELESS VEHICULAR SENSOR NETWORK

(75) Inventor: Karric Kwong, Vallejo, CA (US)

(73) Assignee: Sensys Netoworks, Inc., Bekeley, CA (US)

( * ) Notice: Subject to any disclaimer, the term of this patent is extended or adjusted under 35 U.S.C. 154(b) by 2118 days.

(21) Appl. No.: 11/614,058

(22) Filed: Dec. 20, 2006

(65) Prior Publication Data

US 2007/0208499 A1 Sep. 6, 2007

Related U.S. Application Data

(60) Provisional application No. 60/753,549, filed on Dec. 22, 2005.

(51) Int. Cl.

| | |
|---|---|
| ***G08G 1/00*** | (2006.01) |
| ***G08G 1/017*** | (2006.01) |
| ***G08G 1/042*** | (2006.01) |
| *G08G 1/015* | (2006.01) |
| *G07C 5/00* | (2006.01) |

(52) U.S. Cl.

CPC ..... *G08G 1/042* (2013.01); *G08G 1/017* (2013.01); *G07C 5/008* (2013.01); *G08G 1/015* (2013.01)

(58) Field of Classification Search

CPC ..... G08G 1/042; G08G 1/0104; G08G 1/00; G08G 1/017; G08G 1/052; G08G 1/015; G07C 5/008

USPC ..... 340/933, 941; 701/117–119

See application file for complete search history.

(56) References Cited

U.S. PATENT DOCUMENTS

| | | | | |
|---|---|---|---|---|
| 6,342,845 | B1 * | 1/2002 | Hilliard et al. | 340/941 |
| 7,382,238 | B2 * | 6/2008 | Kavaler | 340/438 |
| 7,382,281 | B2 * | 6/2008 | Kavaler | 340/941 |
| 7,382,282 | B2 * | 6/2008 | Kavaler | 340/941 |
| 7,627,510 | B2 * | 12/2009 | Jain et al. | 705/35 |
| 7,738,413 | B2 * | 6/2010 | Varaiya et al. | 370/321 |
| 7,739,000 | B2 * | 6/2010 | Kevaler | 701/1 |
| 2005/0122231 | A1 * | 6/2005 | Varaiya et al. | 340/870.01 |
| 2006/0095199 | A1 * | 5/2006 | Lagassey | 701/117 |
| 2006/0097894 | A1 * | 5/2006 | Kavaler | 340/941 |
| 2006/0109104 | A1 * | 5/2006 | Kevaler | 340/531 |
| 2006/0132298 | A1 * | 6/2006 | Kavaler | 340/521 |
| 2006/0202863 | A1 * | 9/2006 | Kavaler | 340/941 |
| 2007/0011080 | A1 * | 1/2007 | Jain et al. | 705/37 |
| 2008/0211691 | A1 * | 9/2008 | Kavaler | 340/933 |
| 2008/0218382 | A1 * | 9/2008 | Kavaler | 340/933 |
| 2010/0017103 | A1 * | 1/2010 | Kwong et al. | 701/117 |
| 2010/0017104 | A1 * | 1/2010 | Kwong et al. | 701/117 |

* cited by examiner

*Primary Examiner* — Khoi Tran
*Assistant Examiner* — Dale Moyer
(74) *Attorney, Agent, or Firm* — Earle Jennings

(57) ABSTRACT

Method and apparatus receiving reports from at least two wireless vehicular sensor nodes and stepping through a process of comparing filtered queues to determine the first and the second waveform in time, leading to counting the vehicles passing the magnetic sensors of the wireless vehicular sensor nodes.

19 Claims, 16 Drawing Sheets

METHOD AND APPARATUS FOR COUNTING THE BIDIRECTIONAL PASSAGE OF VEHICLES IN A WIRELESS VEHICULAR SENSOR NETWORK

CROSS REFERENCE TO RELATED APPLICATIONS

This application claims priority to U.S. Patent Application 60/753,549 filed Dec. 22, 2005.

TECHNICAL FIELD

This invention relates to wireless vehicular sensor networks, in particular, to the counting of motor vehicles in such networks.

BACKGROUND OF THE INVENTION

Today, there are numerous situations in which counting how many vehicles are going in which of two directions is useful and important. This can be required in traffic monitoring of a roadways, parking facilities and toll booths. There are two kinds of magnetic sensors that are often used, open loop and magneto-resistive sensors.

The situation has some significant hurdles. Running wires to open loop sensors embedded in roadways turns out to be difficult, expensive, and often unreliable in the rugged environment of a roadway with multiple ton vehicles rolling over everything on a frequent basis. Vehicular sensors employing a wireless communications exchange can be more reliable and less sensitive to the damage of these vehicles and other conditions of these roadways. What is needed is a way to use a report from a wireless vehicular sensor node to count traffic flow on at least one roadway.

SUMMARY OF THE INVENTION

The invention includes a method for counting the passage of a vehicle near a first wireless vehicular sensor node and a second wireless vehicular sensor node in a wireless vehicular sensor network. The method will be discussed in terms of three examples:

- A means for receiving a report from the wireless vehicular sensor nodes, an access point wirelessly communicating with the wireless vehicular sensor nodes of the wireless vehicular sensor network and a processor generating the traffic report with its traffic count from the received reports.
- The processor may be included in the access point and/or the means for receiving.
- Alternatively, the processor may be wireline coupled via network transceivers to the access point and/or the means for receiving.
- While implementations of these examples may include finite state machines as well as computers performing the method, the discussion will focus on the second program system implementing the method.
- This discussion will focus on the scenario involving two wireless vehicular sensor nodes, but is applicable to scenarios involving more than two.

A wireless vehicular sensor node may use any method of generating the reports. Two examples will be discussed to some extent:

- In the first example, the wireless vehicular sensor node uses a method of generating the report based upon at least one member of the group consisting of: a rising edge and a falling edge; wherein the members are determined based upon a vehicle sensor state using the magnetic sensor.
- In the second example, the wireless vehicular sensor node uses a method of generating the report based upon a first time and an ending time using the recent variance of a waveform based upon a vehicle sensor state using the magnetic sensor. The report may include the first time as the rising edge and the ending time as the falling.
- In other embodiments, more information may be included in the report.
- In other embodiments, the rising edge and falling edge may not be reported, but embodiments of the method may compute and/or infer these edges.

The invention also includes apparatus supporting this method as means for receiving the reports from the wireless vehicular sensor nodes and as an access point, which may further include one or more instances of a finite state machine and/or a computer accessibly coupled to a memory and at least partly directed by a program system including at least one program step residing in that memory.

The invention further includes manufacturing the apparatus by providing the means for performing the steps of the method. The apparatus is the product of that manufacturing method.

DETAILED DESCRIPTION

This invention relates to wireless vehicular sensor networks, in particular, to the counting of motor vehicles in such networks.

Figure 1:
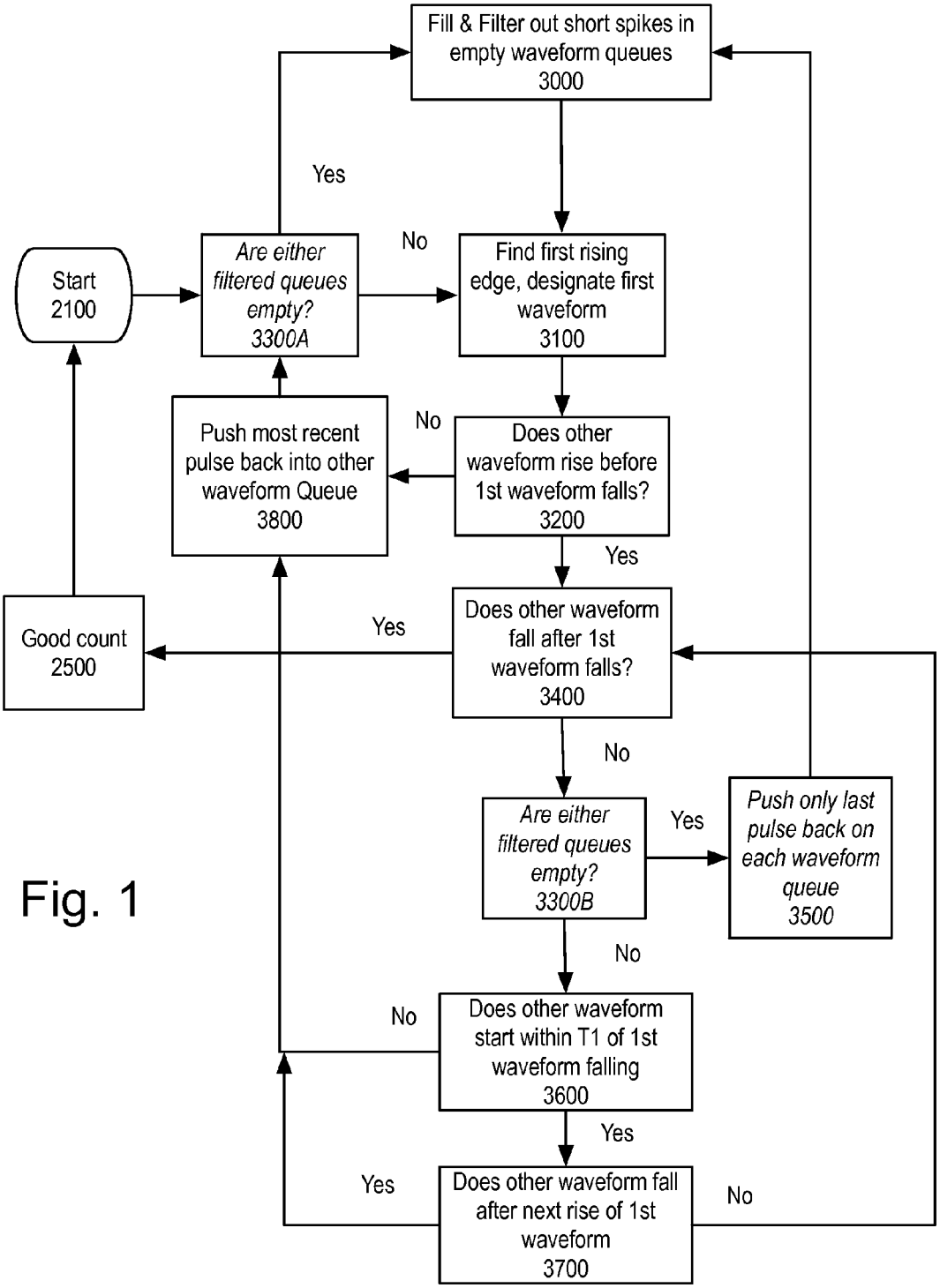
FIG. 1 shows a flowchart of the method of counting a vehicle passing near at least two vehicular sensor nodes as shown in FIGS. 2 and 3, and implemented as the second program system of the access point shown in FIGS. 5A and 5B.
Figure 2:
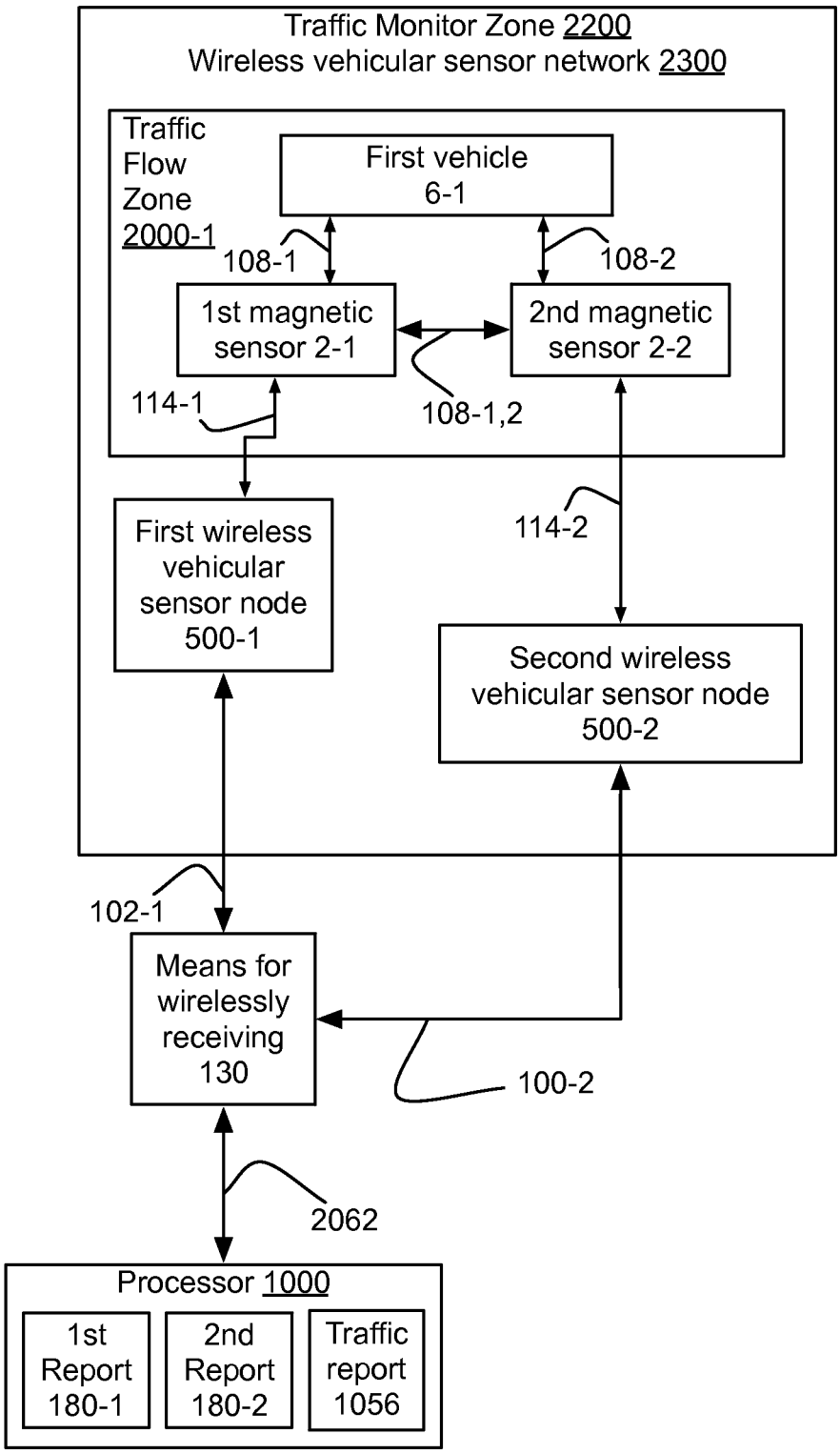
Figure 3:
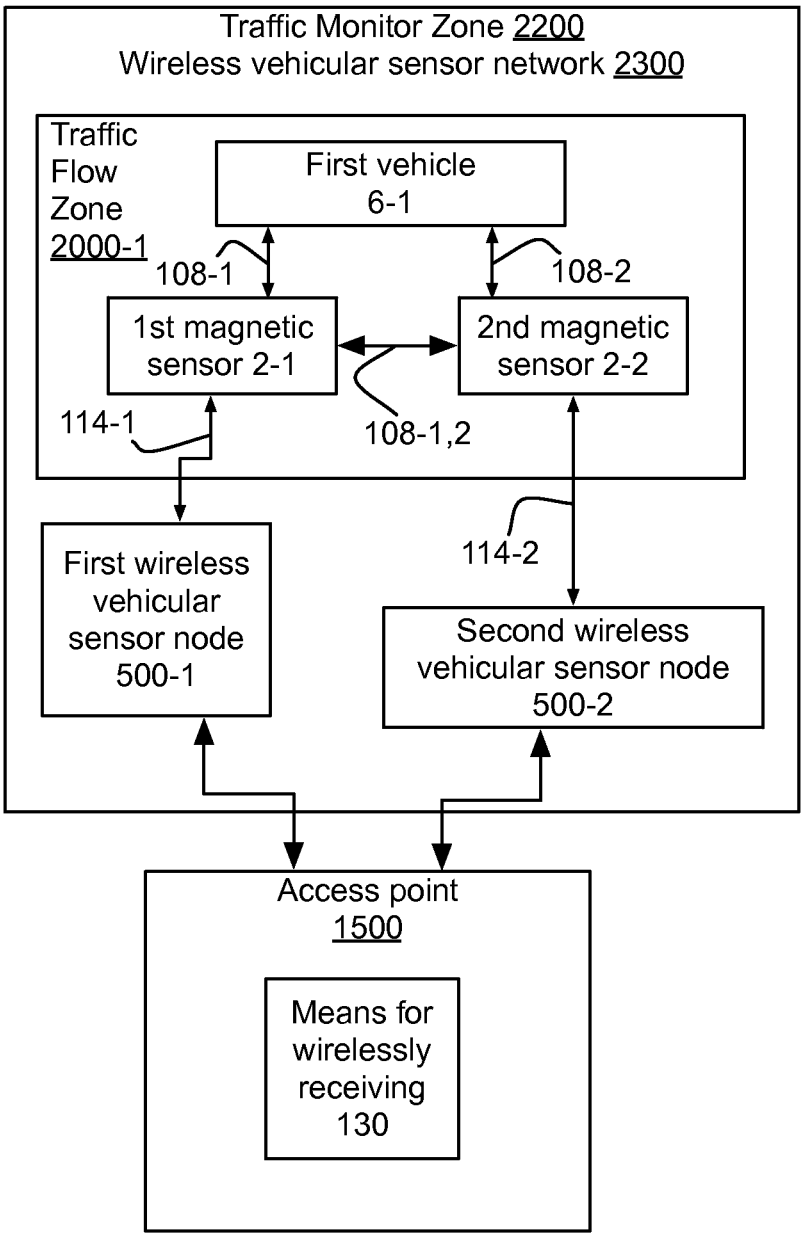
Figure 4:
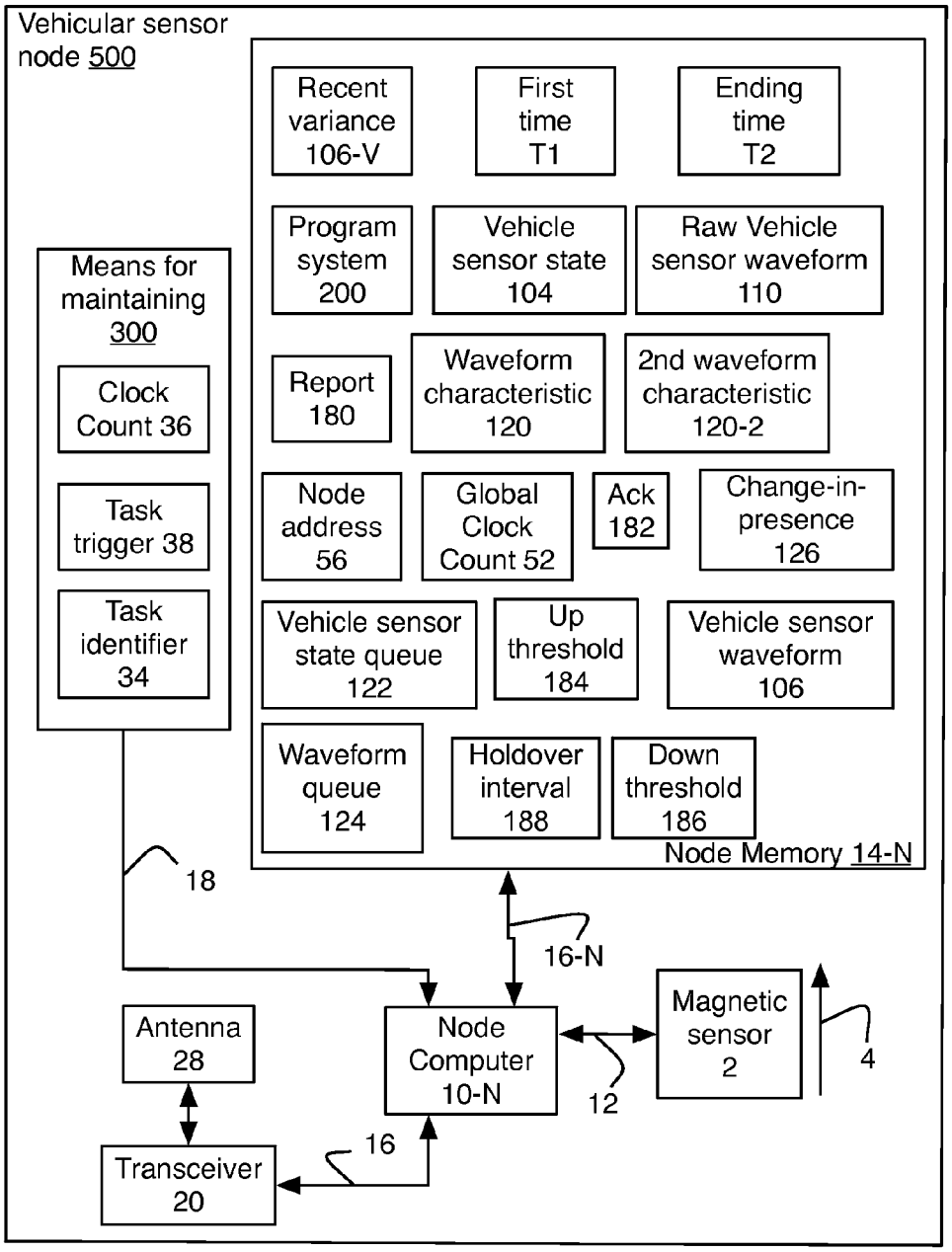
FIG. 4 shows some details of an example of the vehicular sensor node of FIGS. 2 and 3.
Figure 5A:
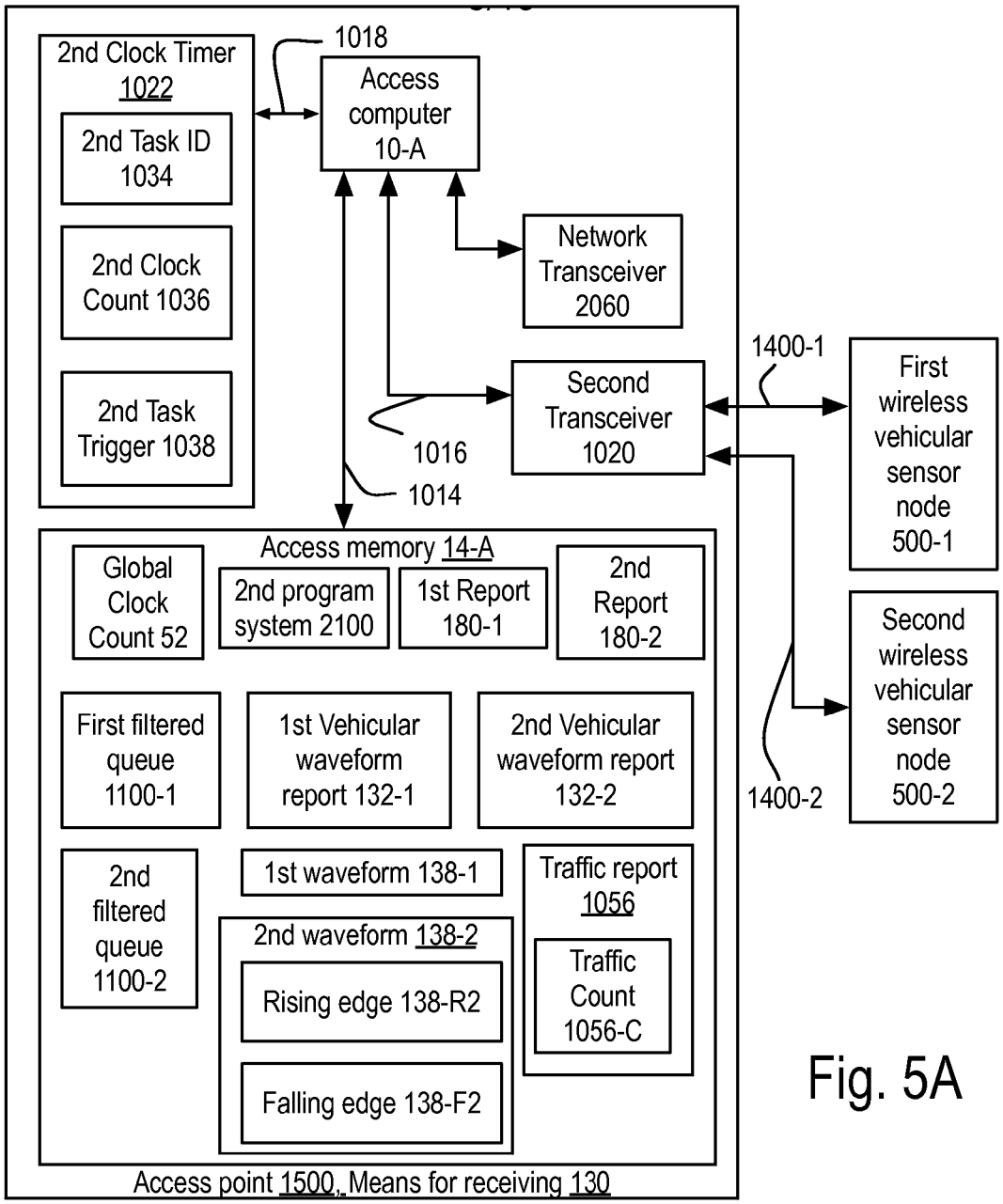
FIG. 5A shows some details of the access point and/or the means for receiving reports from the vehicular sensor nodes as shown in FIGS. 2 and 3.
Figure 5B:
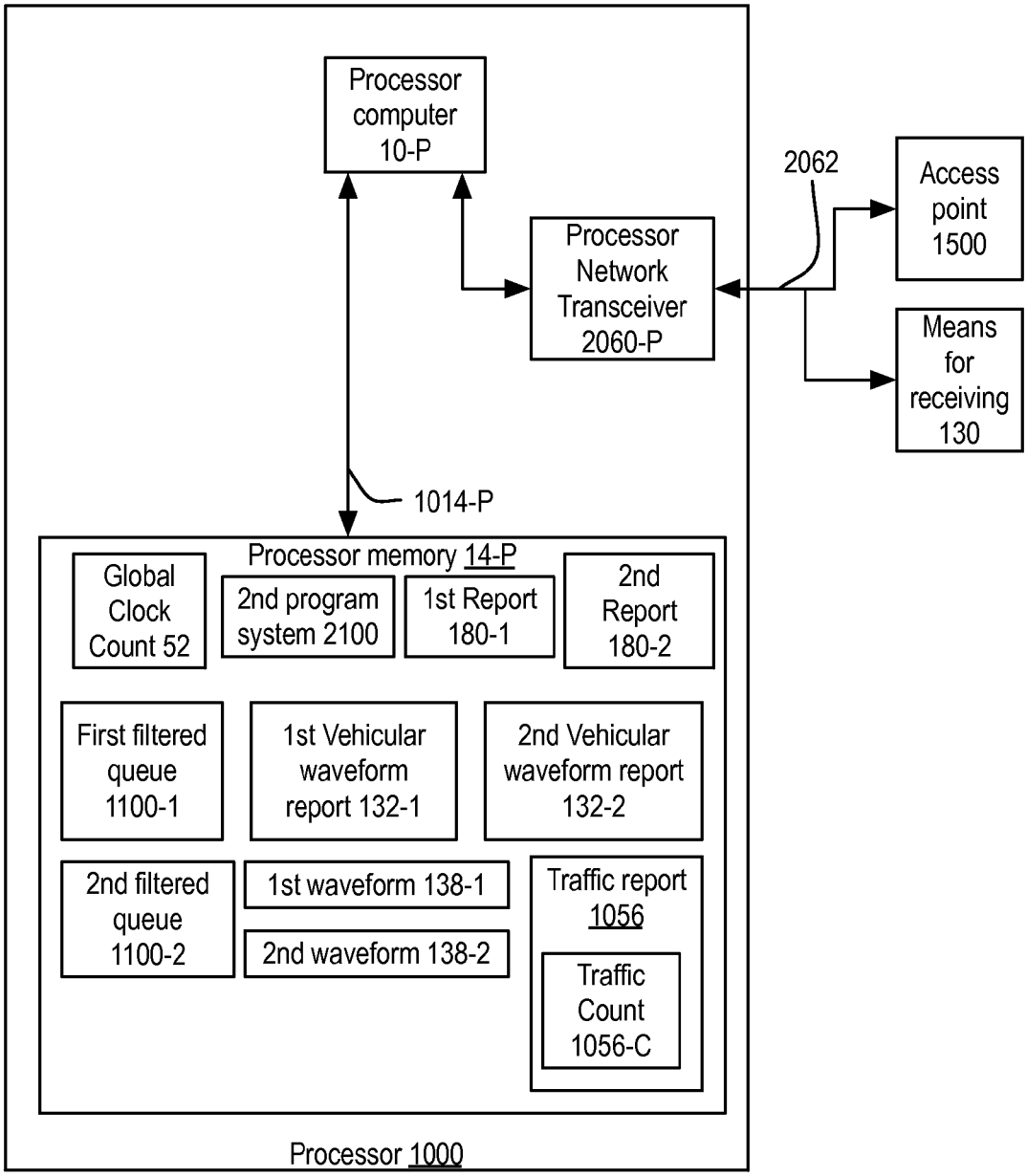
FIG. 5B shows some details of the processor wireline coupled to the access point and/or the means for receiving as shown in previous Figures.
Figure 13A:
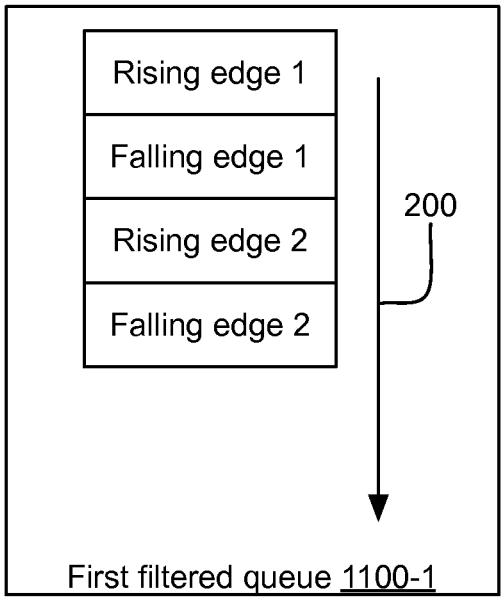
FIGS. 13A to 13D show the results of various activities in a filtered queue.
Figure 13B:
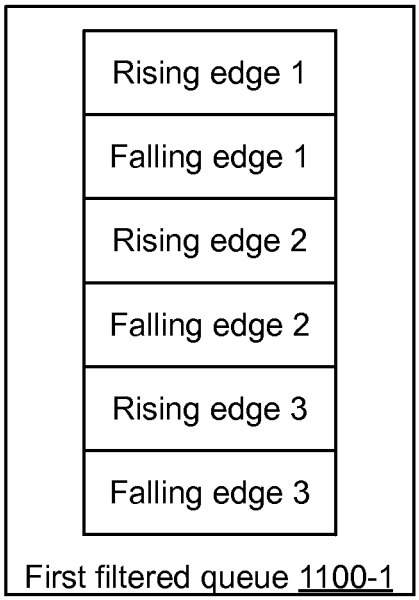
Figure 13C:
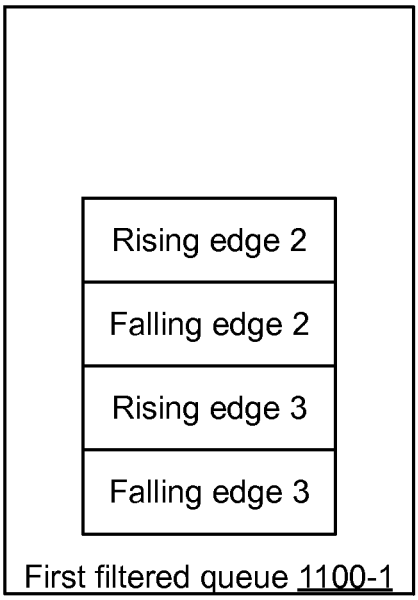
Figure 13D:
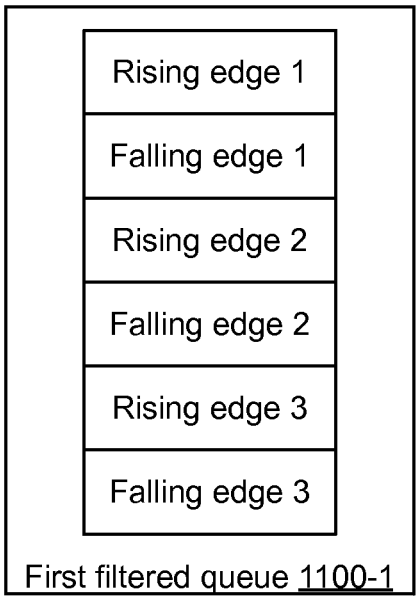
Figure 14A:
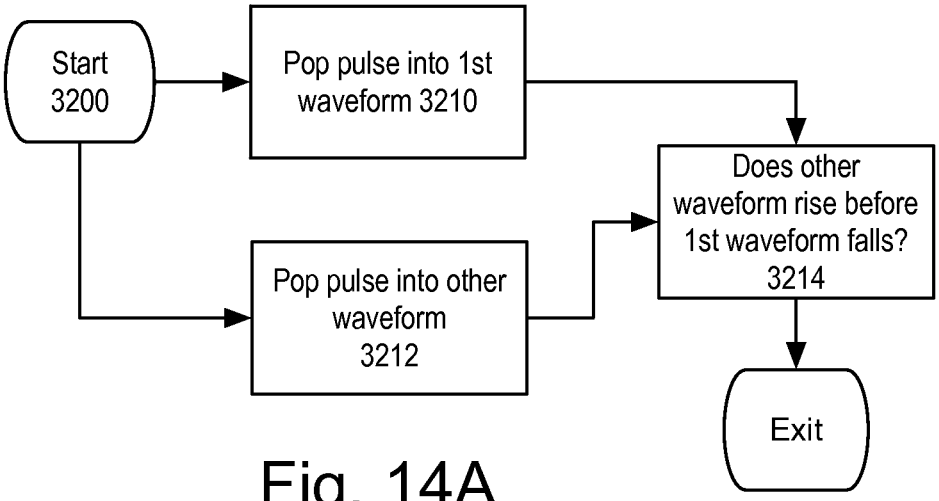
FIG. 14A shows some details of the step 3200 of the flowchart of FIG. 1 regarding whether the second waveform rises before the first waveform falls.
Figure 14B:
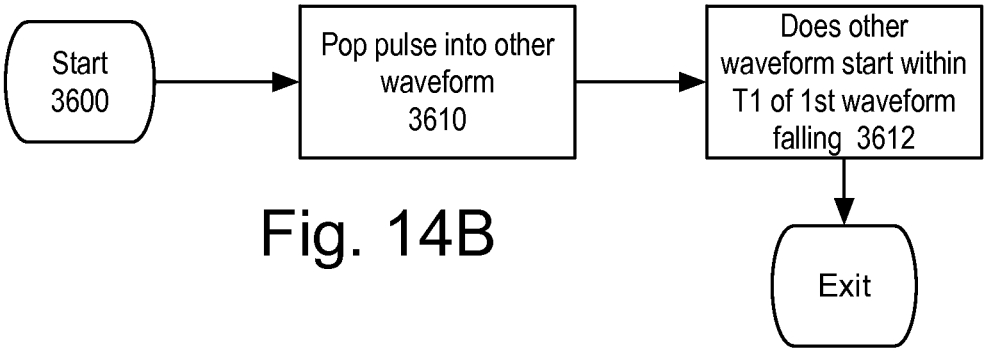
FIG. 14B shows some details of the step 3600 of the flowchart of FIG. 1 regarding whether the second waveform starts with T1 of the first waveform falling.
Figure 14C:
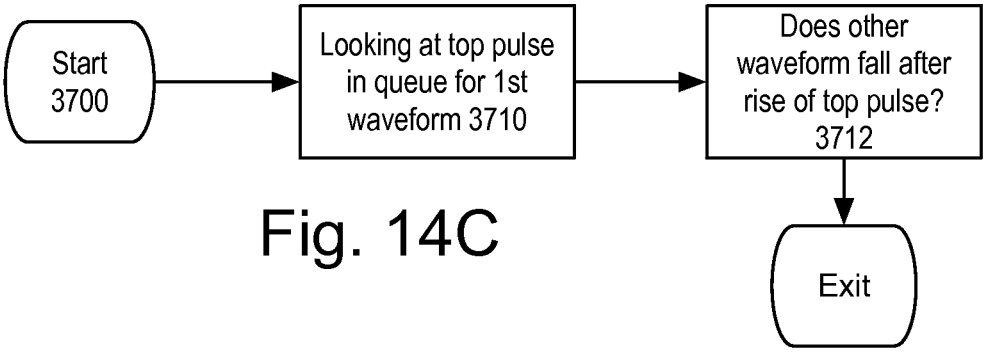
FIG. 14C shows some details of the step 3700 of the flowchart of FIG. 1 regarding looking at the top pulse in the filtered queue for the first waveform and determining if the second waveform falls before the rise of the top pulse.
Figure 15:
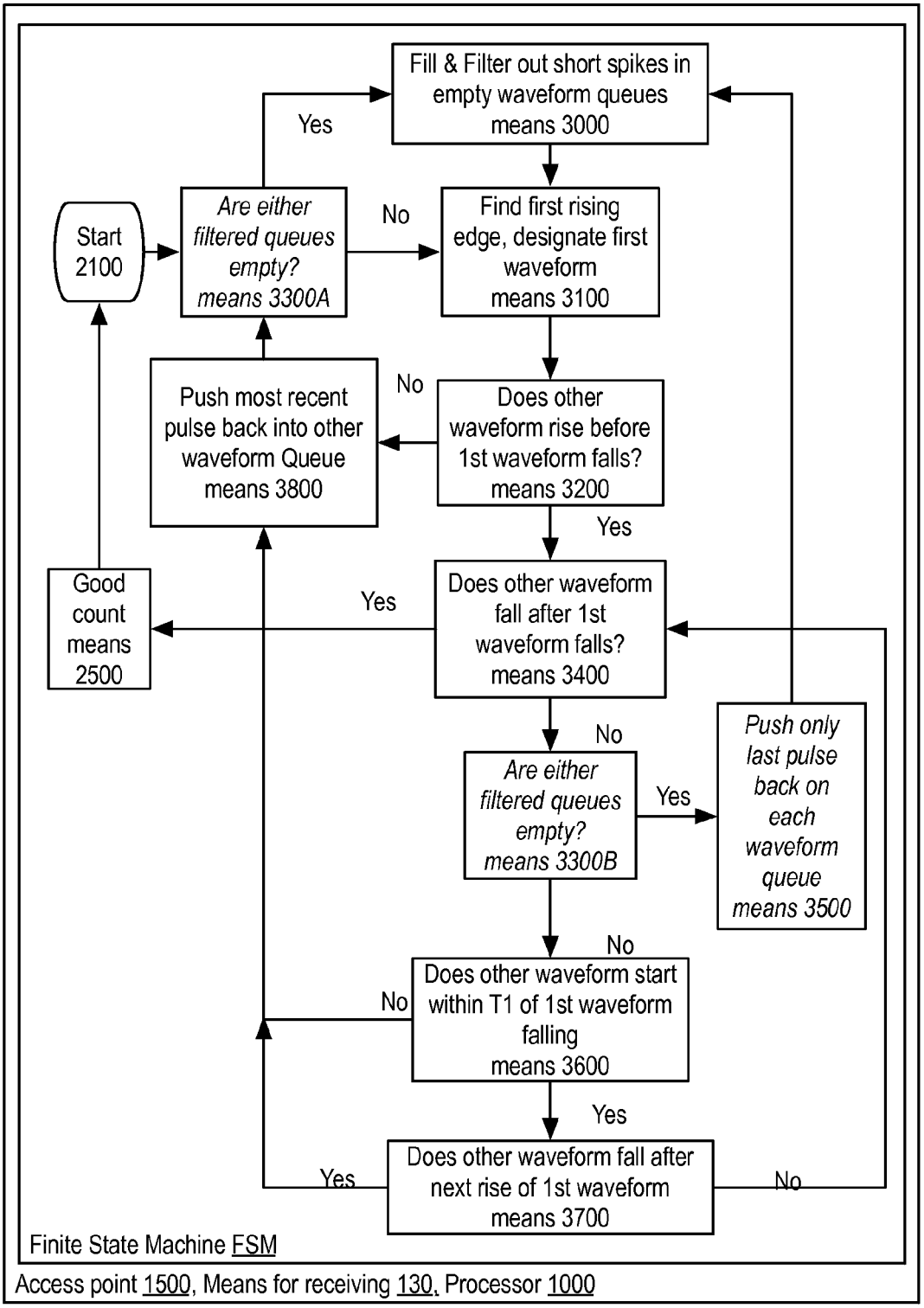
FIG. 15 shows the access point and/or means for receiving including the members of a means group and the means for receiving including a finite state machine implementing the members of the means group.

This application discloses and claims a method for counting the passage of a vehicle 6-1 near a first wireless vehicular sensor node 500-1 and a second wireless vehicular sensor node 500-2 in a wireless vehicular sensor network 2300, as shown in FIGS. 2 and 3. The method will be discussed in terms of three examples:

- A means for receiving 130 a report 180 from the wireless vehicular sensor nodes of FIG. 4, an access point 1500 wirelessly communicating with the wireless vehicular sensor nodes of the wireless vehicular sensor network and a processor 1000 generating the traffic report 1056 with its traffic count 1056-C from the received reports, as further shown in FIGS. 5A and 5B.
- The processor may be included in the access point and/or the means for receiving.
- Alternatively, the processor may be wireline coupled 2062 via network transceiver 2060 to the access point and/or the means for receiving.
- While implementations of these examples may include at least one finite state machine FSM as shown in FIG. 15 and/or at least one computer 10 performing the method as shown in FIGS. 5A and 5B, the discussion will focus on the second program system 2100 implementing the method, which is shown in FIG. 1 and in further detail in FIGS. 11A to 14C.
- This discussion will focus on the scenario involving two wireless vehicular sensor nodes, but is applicable to scenarios involving more than two.

As used herein, each of the relevant wireless vehicular sensor nodes operates a magnetic sensor. By way of example, the first wireless vehicular sensor node 500-1 first operates 114-1 the first magnetic sensor 2-1, and the second wireless vehicular sensor node 500-2 second operates 114-2 the second magnetic sensor 2-2 as shown in FIGS. 2 to 4. At least one, and often preferably, all the wireless vehicular sensor nodes may include their magnetic sensors as shown in FIG. 4.

The means for wirelessly receiving 130 may first wirelessly communicate 100-1 with the first wireless vehicular sensor node 500-1. The means for wirelessly receiving may also second wirelessly communicate 100-2 with the second wireless vehicular sensor node 500-2. Note that these wireless communications may or may not use the same physical transports and/or communications protocols. These wireless communications may be encrypted, and the communications with one wireless vehicular sensor node may or may not be decipherable by the other wireless vehicular sensor node. The principle task of this application is to disclose and claim the method and apparatus supporting that method for counting the vehicles passing the magnetic sensors of these wireless vehicular sensor nodes.

The method for counting, as embodied by the second program system 2100 as shown in FIG. 1, includes the following steps:

- Step 3300 supports determining whether either of the filtered queues are empty.
  - When one or both of the first filtered queue 1100-1 and the second filtered queue 1100-2 are empty, the Yes arrow is used to goto step 3000.
  - When neither is empty, the No arrow is used to goto 3100.
- Step 3000 supports filling and filtering out short spikes in empty filtered queues. Once this step is performed, step 3100 is performed.
- Step 3100 supports finding which of the filtered queues has first rising edge 118-R and designate it the first waveform 138-1, and designate a second waveform 138-2 as the other of the filtered queues. When done, execution proceeds to step 3200.
  - This determines the direction of motion.
  - Pop a pulse from the filtered queue corresponding to the first waveform, into the first waveform.
  - Pop the pulse from the filtered queue corresponding to the second waveform into the second waveform. As used herein, the first waveform and/or the second waveform may preferably include at least one pulse which preferably refers to a rising edge and a falling edge, as shown in FIG. 5A for the second waveform. In that Figure, the second waveform include a rising edge 138-R2 and a falling edge 138-F2.
- Step 3200 support determining whether the second waveform rise before the first waveform falls. If Yes execution proceeds to step 3400, else No, execution proceeds to step 3800.
  - This confirms the overlap of the waveforms, and is the first step if this is a vehicle.
- Step 3400 supports determining whether the second waveform falls after the first waveform falls. If Yes, execution proceeds to step 2500, else No, execution proceeds to the second step 3300.
  - This confirms the follow-through of the direction of travel of the vehicle.
- Step 2500 supports a good count, the count occurs in the direction found by step 3100.
- The second step 3300 also supports determining whether either of the filtered queues are empty.
  - When one or both of the first filtered queue 1100-1 and the second filtered queue 1100-2 are empty, the Yes arrow causes execution to proceed to step 3500.
  - When neither is empty, the No arrow is used to step 3600.
- Step 3500 supports pushing only the last pulse back onto each filtered queue.
- Step 3600 supports determining whether the second waveform starts within a time T1 of the first waveform falling. If Yes, execution proceeds to 3700, else No, proceeds to step 3800.
  - The step pops the other filtered queue into the second waveform before the determining.
- Step 3700 supports determining whether the second waveform falls after the next rise of the first waveform. If Yes, execution proceeds to step 3800, else No, execution proceeds to step 3400.
  - This step peeks into the filtered queue corresponding to the first waveform by one pulse.
- Step 3800 supports pushing most recent pulse into the filtered queue corresponding to the second waveform. Execution proceeds to the first step 3300.

Figure 11A:
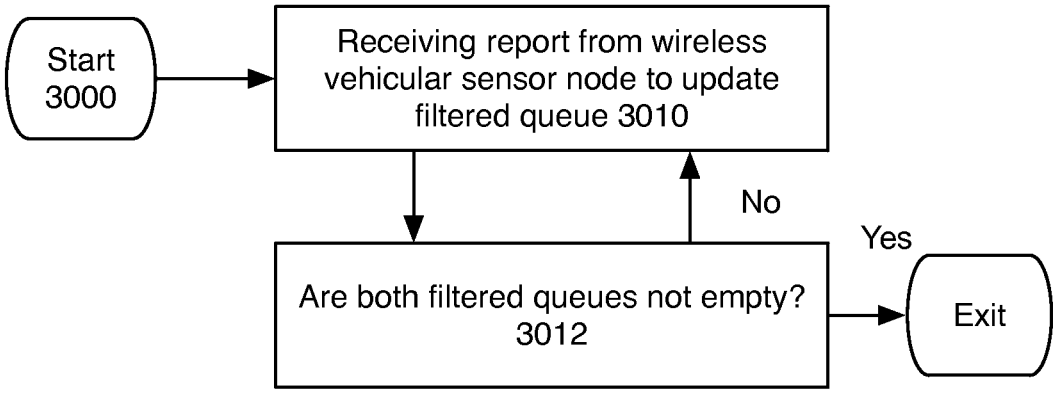
FIG. 11A shows a flowchart refining the step 3000 of the flowchart of FIG. 1 regarding receiving a report from a wireless vehicular sensor node to update its filtered queue.

FIG. 11A shows some details of Step 3000 of FIG. 1. Step 3010 supported receiving a report 180 from a wireless vehicular sensor node 500 to update its filtered queue. Step 3012 determines where both filtered queues are not empty, if Yes, exit, else No, repeat step 3010.

By way of example, Step 3010 supports the report from the first wireless vehicular sensor node 500-1 updates the first filtered queue 138-1.

The report from the second wireless vehicular sensor node 500-2 updates the second filtered queue 138-2.

Figure 11B:
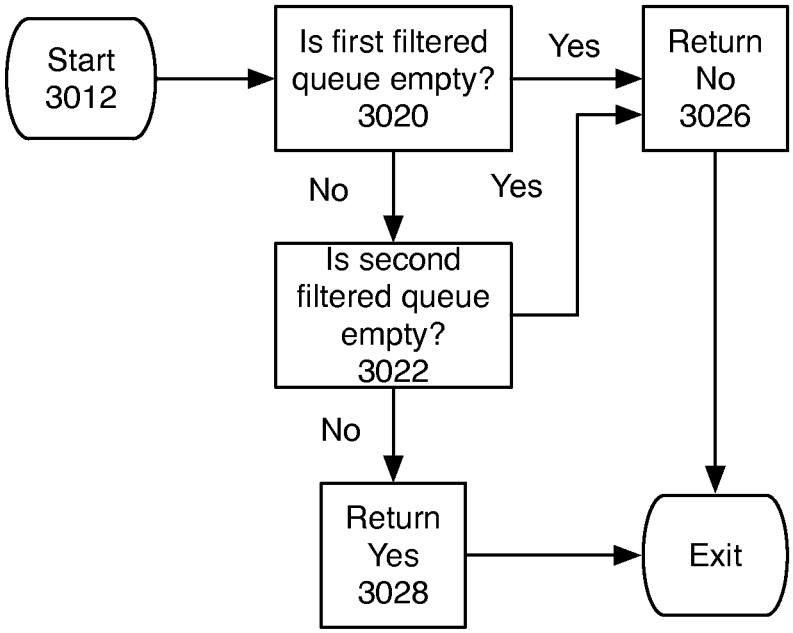
FIG. 11B shows a flowchart of one operation of the flowchart of FIG. 11A.

FIG. 11B shows one way to implement step 3012.

Figure 12A:
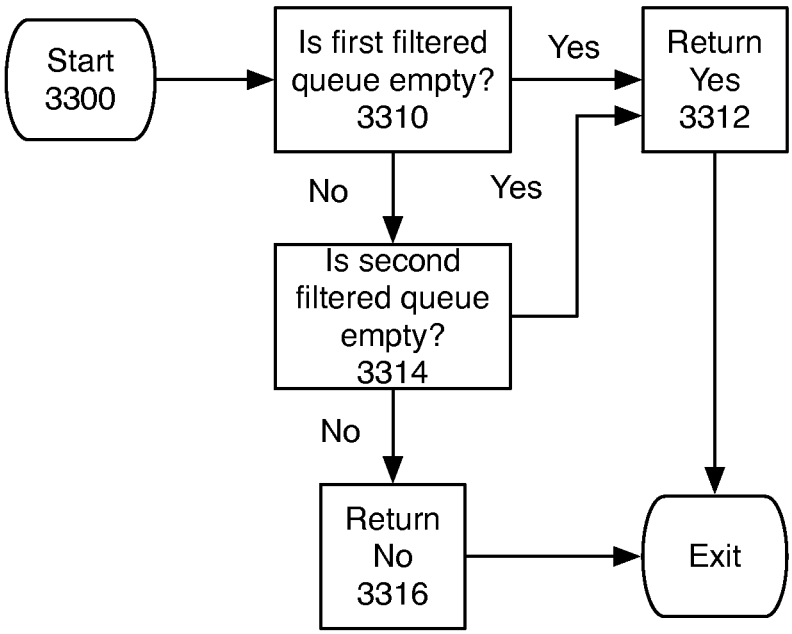
FIG. 12A shows a flowchart refining the step 3300 of the flowchart of FIG. 1 regarding whether either filtered queue is empty.

FIG. 12A shows one way to implement step 3300.

Figure 12B:
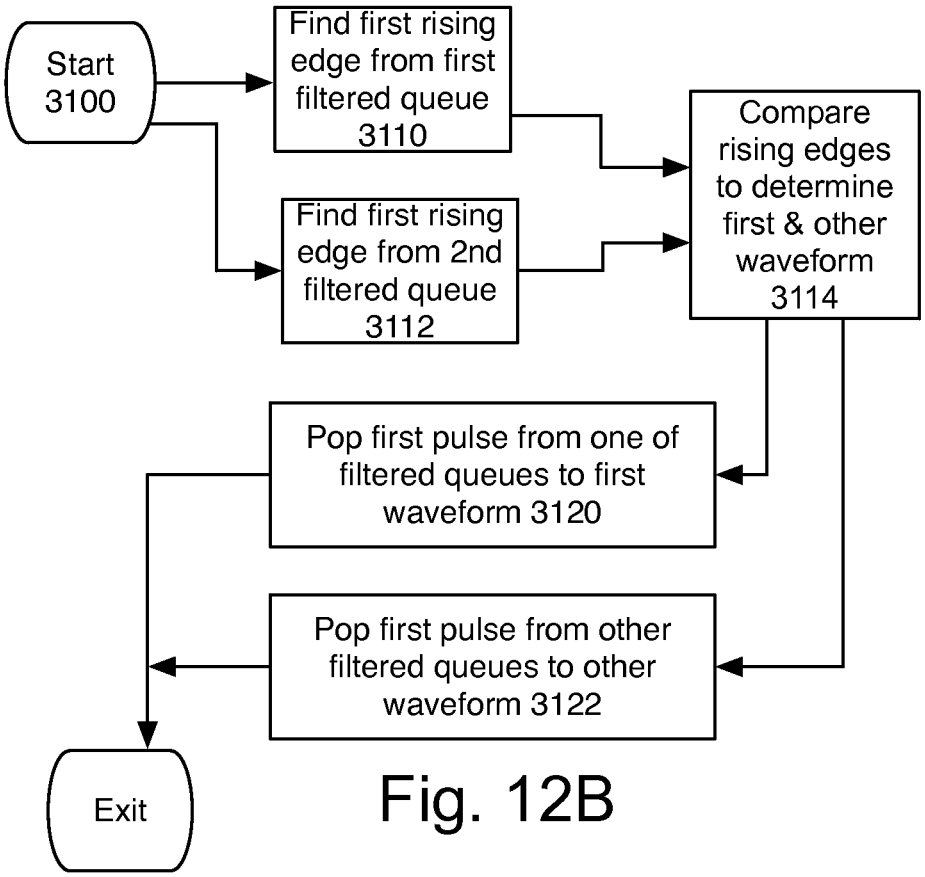
FIG. 12B shows a flowchart refining the step 3100 of the flowchart of FIG. 1 finding the first rising edge and designating it as the first waveform.

FIG. 12B shows one way to implement step 3100, including the following.

Step 3110 supports finding the first rising edge from first filtered queue.

Step 3112 support finding the first rising edge from the second filtered queue.

Step 3114 compares the rising edges to determine the first and second waveform.

By way of example, if the first rising edge of the first filtered queue is before the first rising edge of the second filtered queue, then the first waveform corresponds to the first filtered queue, and the second waveform corresponds to the second filtered queue.

Likewise, if the first rising edge of the first filtered queue is not before the first rising edge of the second filtered queue, then the first waveform corresponds to the second filtered queue, and the second waveform corresponds to the first filtered queue.

Note that the test of before may be implemented as a test for greater than, or as a test for greater than or equal to.

Step 3120 pops the first pulse from the corresponding filtered queue for the first waveform into the first waveform.

Step 3122 pops the first pulse from the corresponding filtered queue for the second waveform into the second waveform.

FIG. 14A shows some details of step 3200 of FIG. 1.

Step 3210 supports popping a pulse into the first waveform from the corresponding filtered queue.

Step 3212 supports popping a pulse into the second waveform the its corresponding filtered queue.

Step 3214 supports determining whether the second waveform rises before the first waveform falls.

FIG. 14B shows some details of step 3600 of FIG. 1.

Step 3610 supports popping a pulse into the second waveform from its corresponding filtered queue.

Step 3612 supports determining whether the second waveform rises within a time T1 of the first waveform falling.

FIG. 14C shows some details of step 3700 of FIG. 1.

Step 3710 supports looking at top pulse in corresponding filtered queue for the first waveform.

Step 3712 supports determining whether the second waveform fall before top pulse rises.

FIGS. 13A to 13D show the results of various activities in a filtered queue, for example, the first filtered queue 1100-1 of the preceding Figures.

FIG. 13A shows an example state for the first filtered queue, including a first pulse with a first rising edge and a first falling edge, which precedes in time 200, a second pulse with a second rising edge and a second falling edge.

FIG. 13B shows the result of receiving a report 180, from the initial state shown in FIG. 13A, adding the third pulse to the queue, which is preceded by the second pulse, which is preceded by the first pulse. The third pulse also has a third rising edge and a third falling edge.

FIG. 13C shows the result of popping a pulse from the filtered queue, given the state shown in FIG. 13B.

FIG. 13D shows the result of pushing the first pulse back onto the filtered queue. The pushing back is used steps 3500 and 3800 of FIG. 1.

The traffic flow zone 2000-1 of FIGS. 2 and 3 includes both the first magnetic sensor 2-1 and the second magnetic sensor 2-2, spaced at a distance between first and second sensors 108-1,2 sufficiently small, that the first vehicle 6-1 is observed by both magnetic sensors. By way of example, the distance between first and second sensors may preferably be less than three meters, further preferably less than two meters, possibly as little as one meter. The first distance 108-1 between the first magnetic sensor and the first vehicle, as well as the second distance 108-2 between the second magnetic sensor and the first vehicle, are both preferably less than three meters, and further preferred to be less than two meters, and may further preferably be less than 1 meter.

A wireless vehicular sensor network 2300 may include the first wireless vehicular sensor node 500-1 and/or the second wireless vehicular sensor node 500-2. Both may preferably be included in the same wireless vehicular sensor network.

By way of example, the access point 1500 may preferably send 168 a time synchronization message to both the first wireless vehicular sensor node 500-1 and the second wireless vehicular sensor node 500-2. The wireless vehicular sensor network 2300 may support at least one wireless communications standard. The network may support the IEEE 802.15 communications standard, or a version of the Global System for Mobile or GSM communications standard. The version may be compatible with a version of the General Packet Radio Service (GPRS) communications standard. The network may support a version of the IS-95 communications standard, or a version of the IEEE 802.11 communications standard.

The processor 1000 of FIGS. 2, 5B and 15 may include a processor network transceiver 2060-P providing a wireline coupling 2062 to at least one access point 1500 and/or at least one means for receiving 130, through which the first report 180-1 from the first wireless vehicular sensor node 500-1 and the second report 180-2 from the second wireless vehicular sensor node 500-2 are received. Some aspects of the invention include the following:

The processor may include a processor computer 10-P processor accessibly coupled 1014-P to the processor memory 14-P as shown in FIG. 5B.

Alternatively, the processor may include a finite state machine FSM implementing the method for counting as shown in FIG. 15.

The various details regarding the other components shown in the processor memory are similar to those shown and discussed in the access point and/or the means for receiving shown in FIG. 5A.

The means for wirelessly receiving 130 may include at least one instance of at least one of a computer shown as the access computer 10-A as shown in FIG. 5A, a finite state machine FSM as shown in FIG. 15, and an inferential engine. The instance at least partly implements the method by wirelessly communicating with at least one of the wireless vehicular sensor nodes. The instance may communicate with the wireless vehicular sensor nodes via the access point.

The access point 1500 may include the means for wirelessly receiving 130. The access point may be a base station communicating with at least one of the first wireless vehicular sensor node and the second wireless vehicular sensor node.

By way of example, the means for wirelessly receiving 130 may include at least one instance of an access computer 10 at least partly implementing the method as shown in FIGS. 1, 5A and 15 by communicating via a receiver 18 with the first wireless vehicular sensor node 500-1 to wirelessly receive 102-1 the first vehicular report 180-1, and with the second wireless vehicular sensor node 500-2 to second wirelessly receive 102-2 the second vehicular report 180-2.

The access computer 10-A is preferably accessibly coupled 1016 with an access memory 14-A including at least one program step included in the second program system 2100 directing the computer in implementing the method discussed in FIGS. 1, and 11A to 14C.

The access computer 10A in communicating with the first and second wireless vehicular sensor nodes may further include the access computer communicating via the access point 1500 with the first wireless vehicular sensor node 500-1 to wirelessly receive 102-1 the first vehicular report 180-1, and with the second wireless vehicular sensor node 500-2 to second wirelessly receive 102-2 the second vehicular report 180-2.

Another example, the means for wirelessly receiving 130 may include at least one instance of a finite state machine FSM at least partly implementing the method as shown in FIG. 15 by communicating via the receiver with the first wireless vehicular sensor node to wirelessly receive the first vehicular waveform report, and with the second wireless vehicular sensor node to wirelessly receive the second vehicular waveform report.

The finite state machine FSM communicating with the wireless vehicular sensor nodes may further include the finite state machine communicating via the access point 1500 with the first wireless vehicular sensor node 500-1 to wirelessly receive 102-1 the first vehicular report 180-1, and with the second wireless vehicular sensor node 500-2 to second wirelessly receive 102-2 the second vehicular report 180-2.

Another example, the means for wirelessly receiving 130 may include at least one instance of an inferential engine at least partly implementing the method by communicating via the receiver with the first wireless vehicular sensor node to wirelessly receive the first vehicular waveform report, and with the second wireless vehicular sensor node to wirelessly receive the second vehicular waveform report.

The inferential engine communicating with the wireless vehicular sensor nodes may further include the inferential engine communicating via the access point 1500 with the first wireless vehicular sensor node 500-1 to wirelessly receive 102-1 the first vehicular report 180-1, and with the second wireless vehicular sensor node 500-2 to second wirelessly receive 102-2 the second vehicular report 180-2.

The receiver 18 may preferably be part of a transmitter/receiver, known herein as a transceiver.

The invention may use more than two wireless vehicular sensor nodes, and include any combination of time-interleaved reception of reports from wireless vehicular sensor nodes.

Some of the figures show flowcharts of at least one method of the invention, which may include arrows with reference numbers. These arrows signify a flow of control, and sometimes data, supporting various implementations of the method. These include at least one the following: a program operation, or program thread, executing upon a computer; an inferential link in an inferential engine; a state transition in a finite state machine; and/or a dominant learned response within a neural network.

The operation of starting a flowchart refers to at least one of the following. Entering a subroutine or a macro instruction sequence in a computer. Entering into a deeper node of an inferential graph. Directing a state transition in a finite state machine, possibly while pushing a return state. And triggering a collection of neurons in a neural network. The operation of starting a flowchart is denoted by an oval with the word "Start" in it.

The operation of termination in a flowchart refers to at least one or more of the following. The completion of those operations, which may result in a subroutine return, traversal of a higher node in an inferential graph, popping of a previously stored state in a finite state machine, return to dormancy of the firing neurons of the neural network. The operation of terminating a flowchart is denoted by an oval with the word "Exit" in it.

A computer as used herein will include, but is not limited to, an instruction processor. The instruction processor includes at least one instruction processing element and at least one data processing element. Each data processing element is controlled by at least one instruction processing element.

A wireless vehicular sensor node 500 may use any method of generating the report 180. Two examples will be discussed to some extent:

In the first example, the wireless vehicular sensor node may use a method of generating the report based upon at least one member of the group consisting of: a rising edge 118-R and a falling edge 118-F; wherein the members are determined based upon a vehicle sensor state 114 using the magnetic sensor 2.

In the second example, the wireless vehicular sensor node may use a method of generating the report based upon a first time T1 and an ending time T2 using a recent variance 106-V of a vehicular sensor waveform 106. The report may include the first time as the rising edge and the ending time as the falling edge. The passage of the waveform and the recent variance across thresholds is used to determine the first time In other embodiments, more information may be included in the report.

In other embodiments, the rising edge and falling edge may not be reported, but embodiments of the method may compute and/or infer these edges.

Figure 9A:
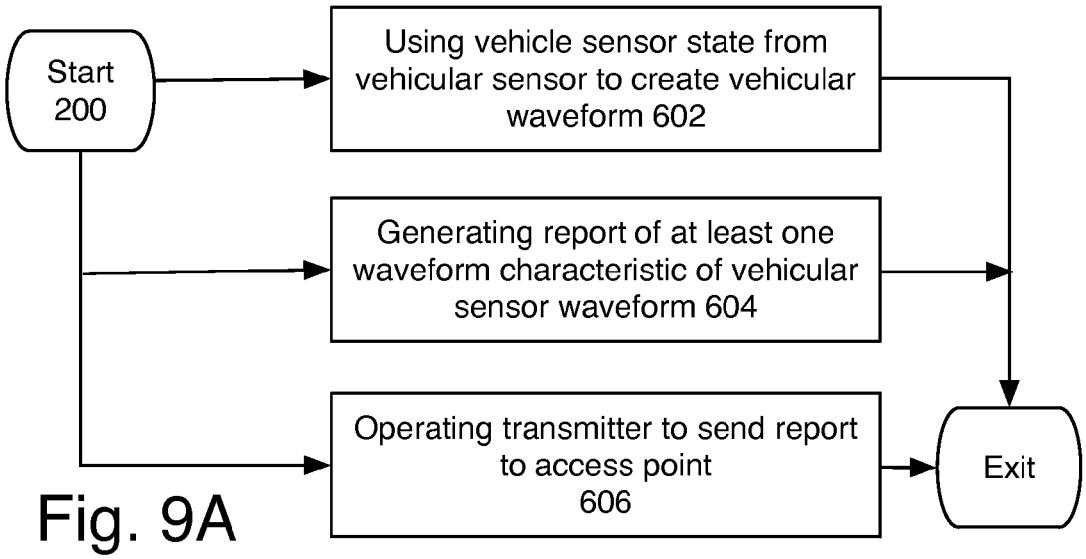
FIG. 9A to 9C show flowcharts of the overall operation of the vehicular sensor node in using the sensor state to generate a report sent to the access point and receive acknowledge of its receipt as details of the program system of the vehicular sensor node of FIG. 4.

The wireless vehicular sensor node 500 of FIG. 4 may operate as implemented by the program system as shown in FIG. 9A. Operation 602 supports using a vehicle sensor state 104 from a vehicular sensor 2 to create a vehicular sensor waveform 106 based upon the presence of the vehicle 6. Operation 604 supports generating a report 180 of at least one waveform characteristic 120 of the vehicular sensor waveform 106. Operation 606 supports operating a transmitter 22 to send the report 180 across at least one wireless physical transport 1510 to an access point 1500 included the wireless vehicular sensor network 2300, to approximate the vehicular sensor waveform at the access point.

Figure 9B:
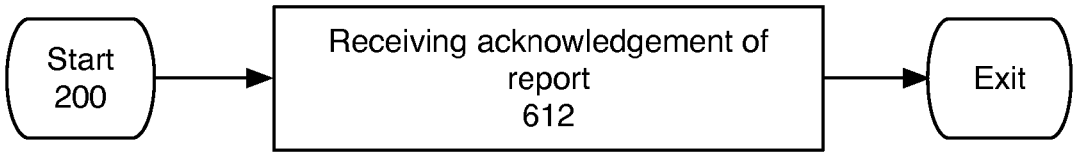
Figure 9C:
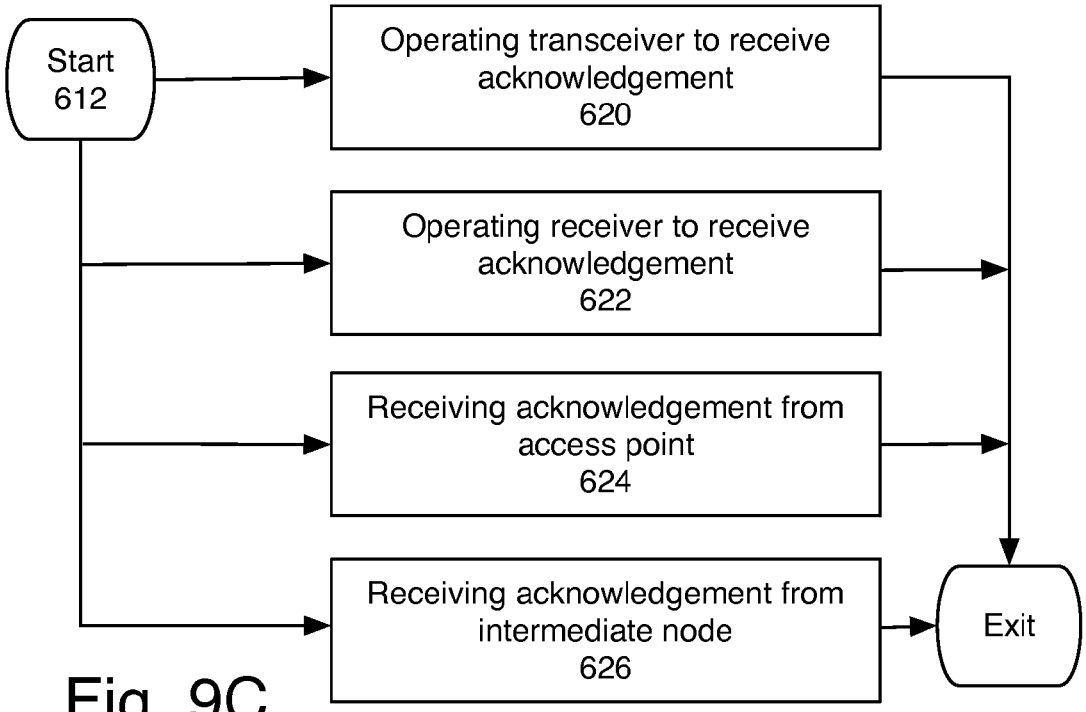

The program system 200 of FIG. 4 and FIG. 9A may further support operation 212 receiving an acknowledgement 182, as shown in FIG. 9B, of the report 180 in FIGS. 13B and 14. The operation 612 of FIG. 9B may further include at least one of the following operations of FIG. 9C. Operation 620 supports operating the transceiver 20 to receive the acknowledgement 182. Operation 622 supports operating a receiver to receive the acknowledgement. Operation 624 supports receiving the acknowledgement from the access point 1500. Operation 626 supports receiving the acknowledgement from the intermediate node 580.

By way of example, suppose a vehicle 6 approaches the wireless vehicular sensor node 500. The vehicular sensor state 104 is used to update the vehicle sensor state queue 122, as supported by operation 230 of FIG. 10B. The vehicular sensor waveform 106 is derived from the vehicle sensor state queue, as supported by operation 232 and discussed regarding FIG. 6A to FIG. 8C. A change-in-presence 126 of the vehicle is determined based the vehicular sensor waveform, as supported by operation 234. Usually this would be determined by a rising edge 108 in the vehicular sensor waveform. The waveform queue 124 is updated with a waveform characteristic 120, when the change-in-presence is indicated. Preferably, this waveform characteristic would indicate the rising edge.

To continue the example, suppose the vehicle 6 moves away from wireless vehicular sensor node 500 at a later time. The operations of FIG. 10B would support using the vehicle sensor state 104 in much the same way. The change-in-presence 126 of the vehicle is determined based the vehicular sensor waveform 106, as supported by operation 234, and would preferably be determined by a falling edge 110 in the vehicular sensor waveform. The waveform queue 124 is updated with a waveform characteristic 120, when the change-in-presence is indicated. Preferably, this waveform characteristic would indicate the falling edge.

The wireless vehicular sensor node 500 may preferably include the magnetic sensor 2, preferably having a primary sensing axis 4 for sensing the presence of a vehicle 6, as shown in FIG. 4, and used to create the vehicle sensor state 104. It is often preferred that the vehicular sensor is the magnetic sensor. The magnetic sensor may preferably employ a magneto-resistive effect and preferably includes a more than one axis magneto-resistive sensor to create a vehicle sensor state.

By way of example, the magnetic sensor 2 may include a two axis magneto-resistive sensor. A two axis magneto-resistive sensor may be used to create the vehicle sensor state as follows. The X-axis may be used to determine motion in the primary sensor axis 4. The Z-axis may be used to determine the presence or absence of a vehicle 6.

Another example, the magnetic sensor 2 may further preferably include a three axis magneto-resistive sensor. A three axis magneto-resistive sensor may be used to create the vehicle sensor state as follows. The X-axis may also be used to determine motion in a primary sensor axis 4. The Y-axis and Z-axis may be used to determine the presence or absence of a vehicle 6. In certain embodiments, the Euclidean distance in the Y-Z plane is compared to a threshold value, if greater, then the vehicle is present, otherwise, absent. The vehicular sensor may preferably include one of the magneto-resistive sensors manufactured by Honeywell.

Transmitting the report 180 and/or the long report 190 uses at least one wireless physical transport. The wireless physical transport may include any of an ultrasonic physical transport, a radio-frequency physical transport, and/or an infrared physical transport. Transmitting reports may be spread across a frequency band of the wireless physical transport. More particularly, the transmitting of reports may include a chirp and/or a spread spectrum burst across the frequency band.

Figure 10A:
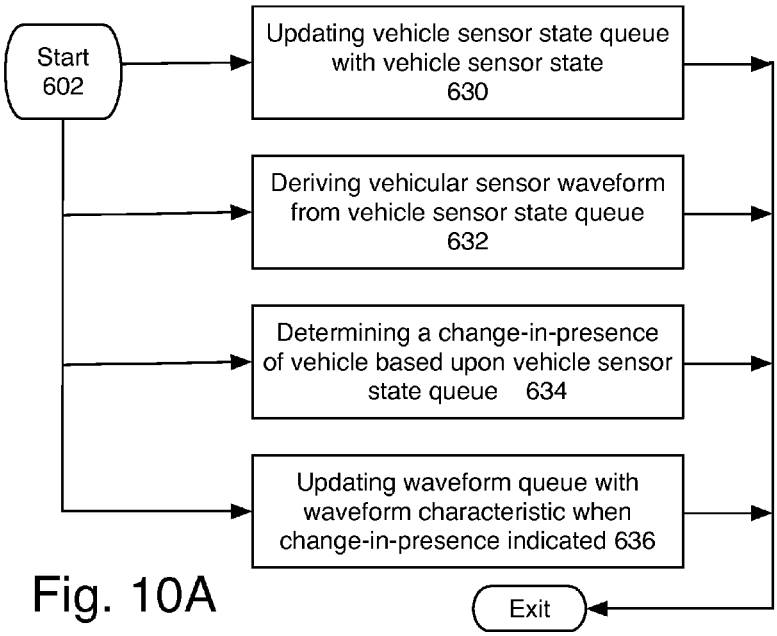
FIGS. 10A and 10B show flowcharts of the first method of generating the report illustrated in FIGS. 6A to 8C.
Figure 10B:
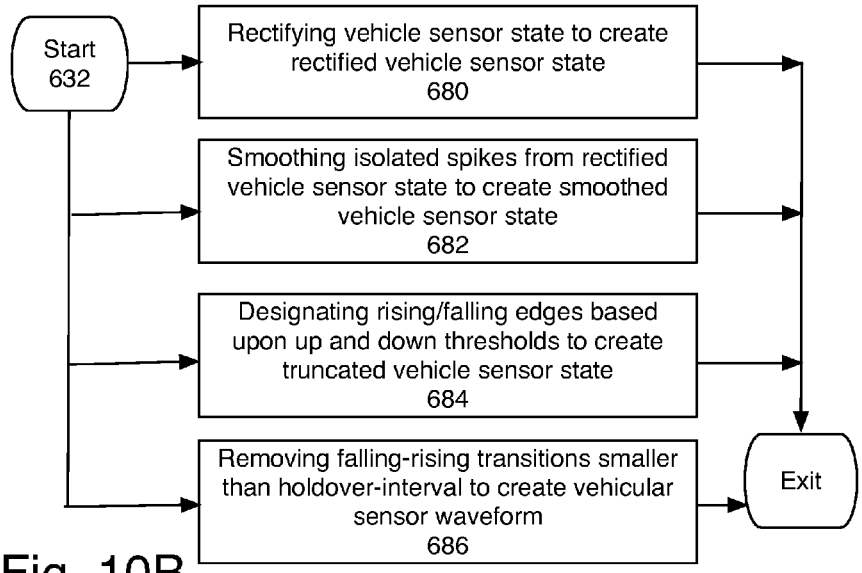

FIG. 10B shows some details of operation 632 of FIG. 10A, further using the vehicle sensor state 104 from the magnetic sensor 2 to create a waveform characteristic 120. Operation 680 supports updating the vehicle sensor state queue 122 of FIG. 14 with the vehicle sensor state. Operation 682 supports deriving the vehicular sensor waveform 106 from the vehicle sensor state queue. Operation 684 supports determining a change-in-presence 126 of the vehicle 6 based upon the vehicle sensor state queue. Operation 686 supports updating the waveform queue 124 with the waveform characteristic when the change-in-presence is indicated.

Figure 6A:
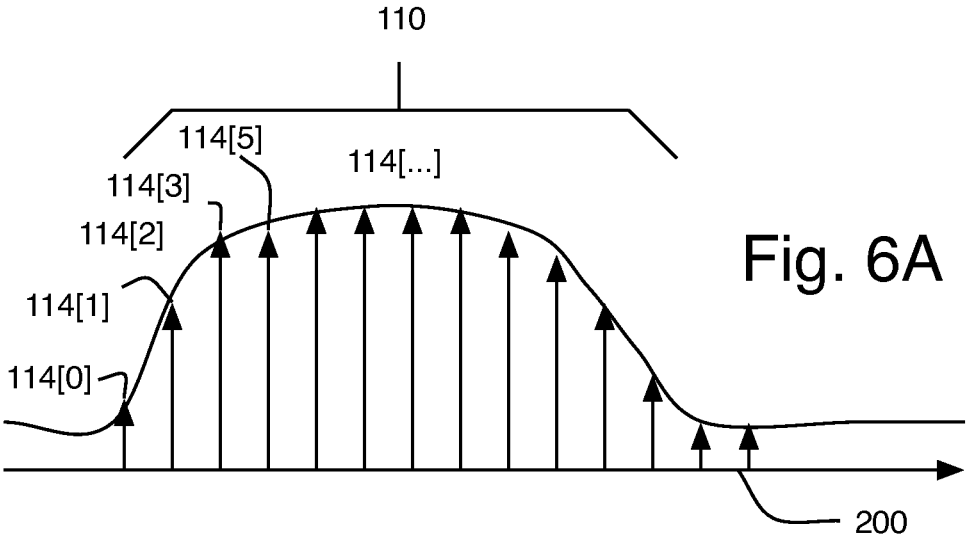
FIGS. 6A to 8C show a first method of deriving a report by a vehicular sensor node to be sent to the access point for use by the method of counting vehicles as shown in FIG. 1.
Figure 6B:
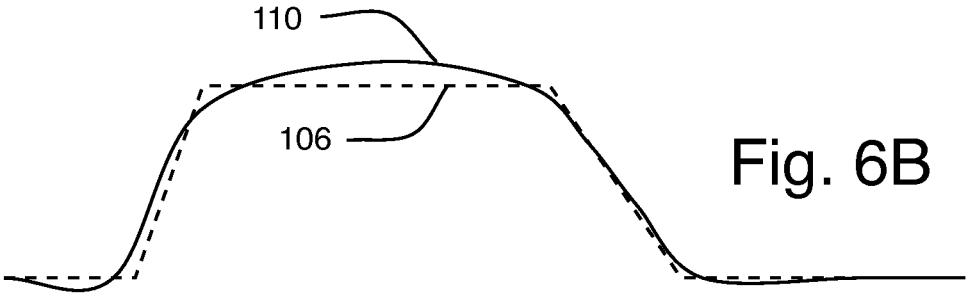
Figure 6C:
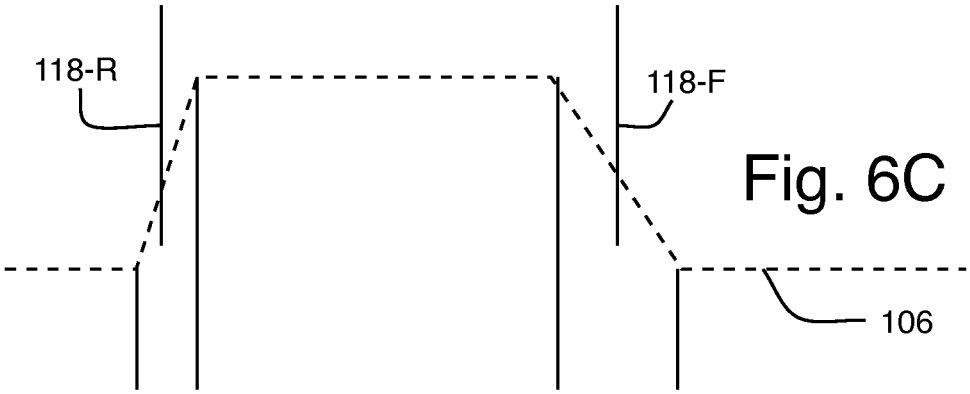

FIG. 6A to FIG. 6C show various aspects of the vehicular sensor waveform 106 created by the invention in response to the presence of a vehicle 6. A vehicle sensor state 104, is collected over time 200, to create the vehicular sensor waveform, which may preferably be represented by at least one waveform characteristic 120. Such a waveform characteristic may represent a rising edge 108, a falling edge 110, a waveform midpoint 114, and/or a waveform duration 112. In traffic control situations, reporting the rising edge and/or falling edge can help indicate length of a vehicle, which can further help in estimating vehicle velocity.

Figure 7A:
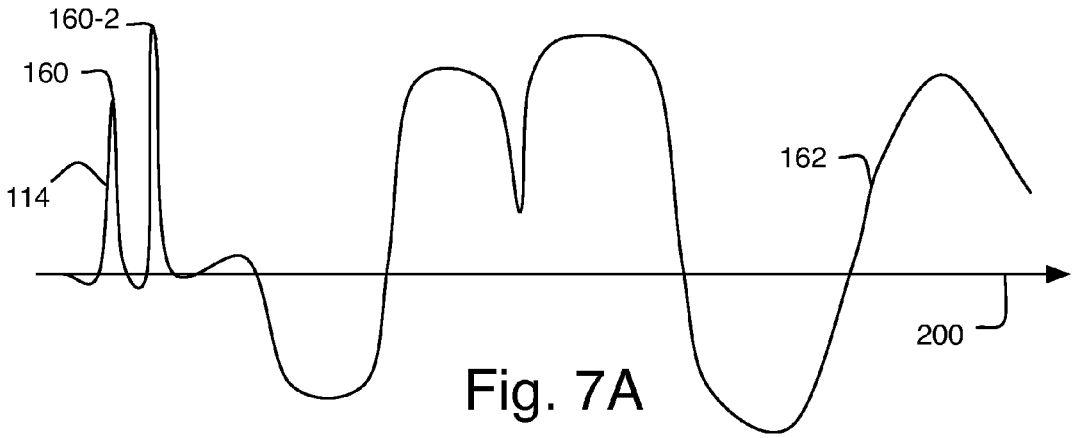
Figure 7B:
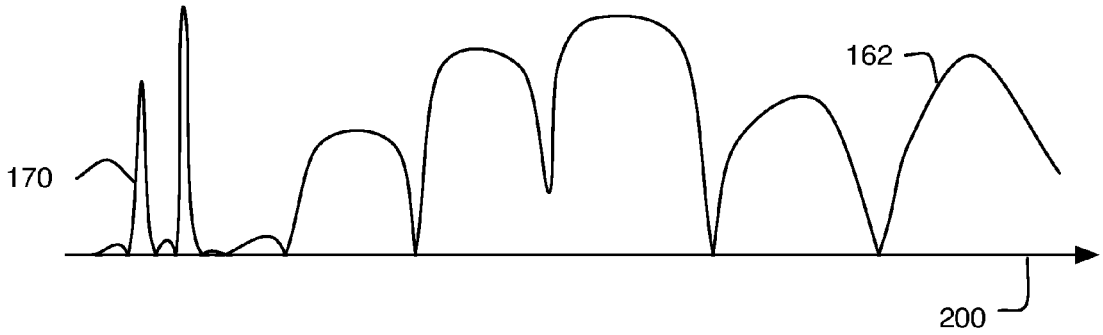
Figure 7C:
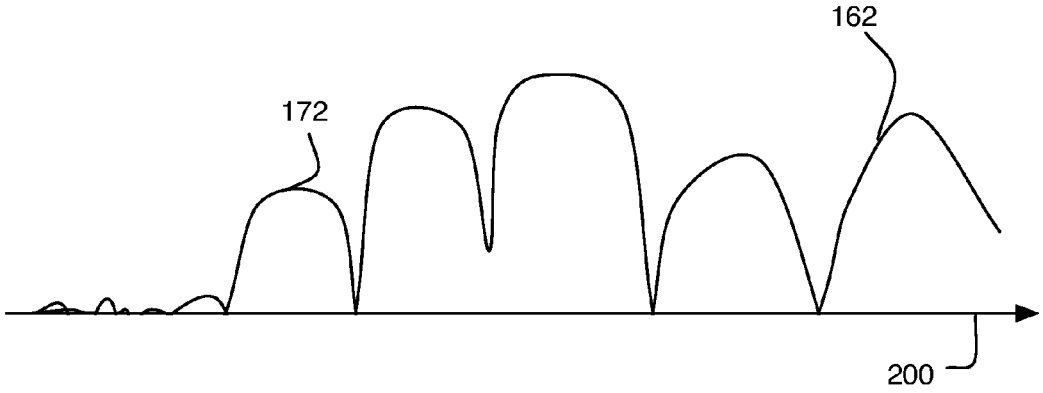
Figure 8A:
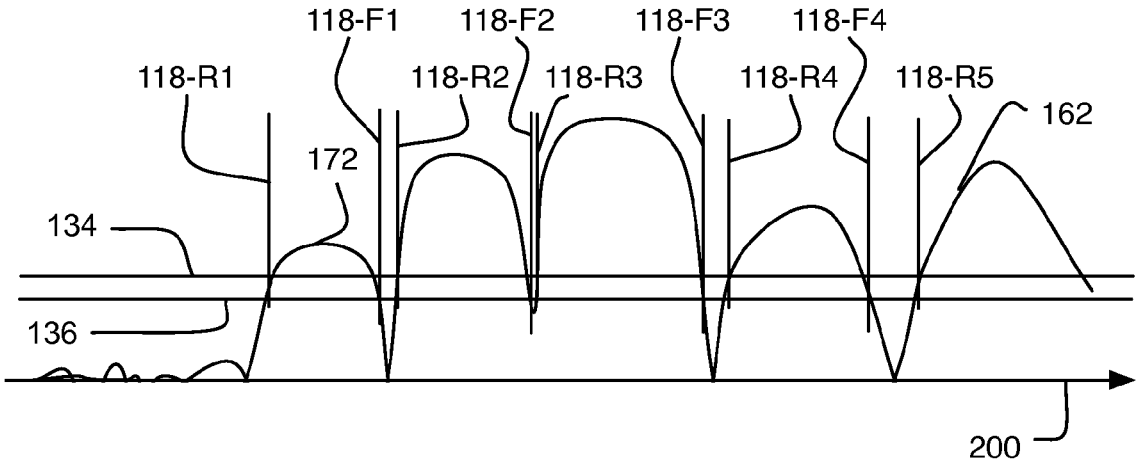
Figure 8B:
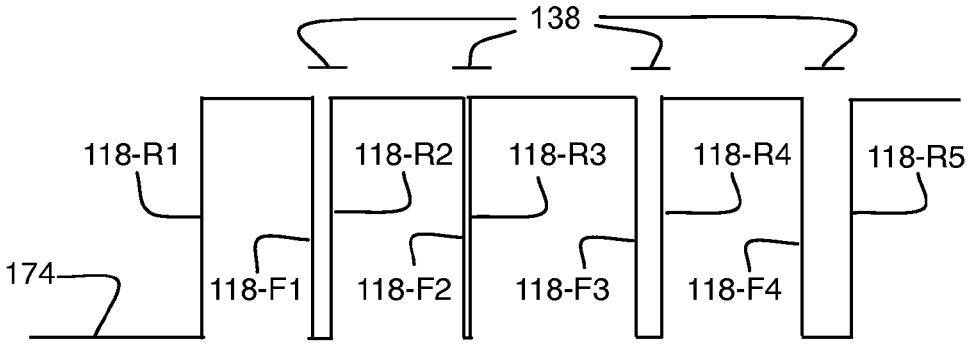
Figure 8C:
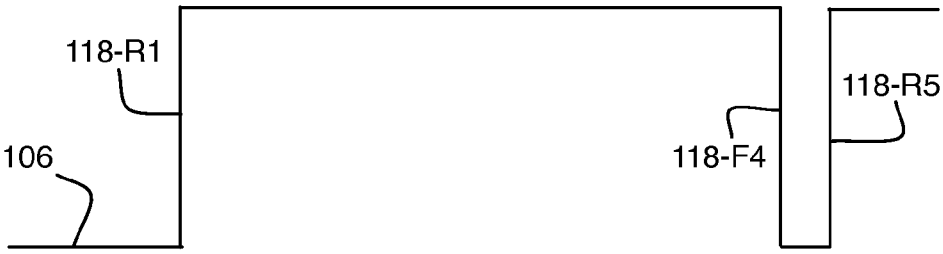

Often, the vehicle sensor state 104, when collected over time 200, is more chaotic, as shown in FIG. 7A. There may be an isolated spike 160, or more than one, as shown by the second isolated spike 160-2. As used herein, an isolated spike will refer to one of a small number of vehicle sensor states, that are large, and surrounded in time by small values of the vehicle sensor state. The small number is shown as one value the isolated spike 160, and two values in the second isolated spike 160-2. In certain embodiments, the small number may be as large as three to five.

The vehicle sensor state 104 may vary quickly in sign, even while one vehicle is passing near the vehicular sensor 2. Also confusing the picture, a second vehicle passing soon after the first vehicle may quickly stimulate the vehicular sensor 2 a second time 162.

The invention includes the vehicle sensor state 104, shown in FIG. 7A as details of operation 632 of FIG. 10B, deriving the vehicular sensor waveform 106 from the vehicle sensor state queue 122. Operation 680 supports rectifying the vehicle sensor state 104 of FIG. 7A to create the rectified vehicle sensor state 170 of FIG. 7B. Operation 682 supports smoothing an isolated spike 160 in the rectified vehicle sensor state creates the smoothed vehicle sensor state 172 of FIG. 7C. Operation 684 supports designating rising edges and falling edges of the smoothed vehicle sensor state 172 based upon the up-threshold 134 and the down-threshold 136 of FIG. 4 to create the truncated vehicle sensor state 174 of FIG. 8B. And operation 686 supports removing falling-rising transitions smaller than the holdover-interval 138 in the truncated vehicle sensor state 174 to create a preferred embodiment of the vehicular sensor waveform 106 shown in FIG. 8C.

This method of signal conditioning may or may not use additional memory to perform its operations. It removes false positives caused by the isolated spike 160. It also removes false positives caused by the vehicle sensor state 104 varying in sign while one vehicle passes near the vehicular sensor 2.

The up-threshold 134 is often preferred to be larger than the down-threshold 136. The up-threshold is preferred to be about 40 milli-gauss. The down-threshold is preferred to be about 22 milli-gauss. These values for the up-threshold and the down-threshold are typical for North America, and may be calibrated differently elsewhere. The holdover-interval 138 is often preferred between 10 milliseconds (ms) and 300 ms. The units of the up-threshold and down-threshold are in the units of the vehicular sensor 2. The units of the holdover-interval are preferably in terms of time steps of a time division multiplexing scheme controlled by synchronization with the access point 1500 preferably acting to synchronize each wireless vehicular sensor node 500 in the wireless vehicular sensor network 2300. Often these units may be preferred to be in terms of 1/1024 of a second, or roughly 1 ms.

The transceiver 20 of FIG. 4 may communicate across a wireless physical transport 1510, which may include any combination of an ultrasonic physical transport, a radio physical transport, and an infrared physical transport. Different embodiments of the wireless vehicular sensor node 500 may use difference combinations of these transmitters and/or transceivers. Where useful, the wireless vehicular sensor node includes an antenna 28 coupling with the transceiver 20 as shown, or to a transmitter, which is not shown. The antenna may preferably be a patch antenna.

The report 180 and/or the long report 190 may further identify the wireless vehicular sensor node 500 originating the report. Transmitting the report may initiate a response across the wireless physical transport, preferably from an access point. The response may be an acknowledgement 182 of receiving the report.

The report 180 may include at least one waveform characteristic 120 of at least one vehicular sensor waveform 106 indicating a change in the presence of a vehicle 6 passing near the wireless vehicular sensor node. In certain embodiments, multiple waveform characteristics may be included in the report for at least one vehicular sensor waveform. Multiple vehicular sensor waveforms may be included in the report, each with at least one waveform characteristic. More than one vehicular sensor waveforms included in the report may include more than one waveform characteristic.

Consider the following example of a wireless vehicular sensor network 2300 including an access point 1500 and multiple wireless vehicular sensor nodes as shown in FIGS. 2 and 3. One preferred embodiment of this network includes using a synchronous time division multiple access protocol based upon the IEEE 802.15.4 communications protocol. The access point transmits a synchronization message, which is received by the wireless vehicular sensor nodes, and permits them to synchronize on a system clock. Preferably, a wireless vehicular sensor node 500 includes a means for maintaining 300 a clock count 36, task trigger 38, and task identifier 34, as shown in FIG. 4.

By way of example, the time division multiple access protocol may synchronize the wireless vehicular sensor network 2300 to operate based upon a frame with a frame time period. The frame time period may preferably approximate at least one second. The time division multiple access protocol may operate in terms of time slots with a time slot period. The time slot period may be preferred to be a fraction of the frame time period. The fraction may preferably be a power of two. The power of two may preferably be one over 1K, which refers to the number 1,024. The time slot period then approximates a millisecond. The wireless vehicular sensor network may further organize the report 180 in terms of a meta-frame, which may preferably have a meta-frame time period as a multiple of the frame time period. The meta-frame time period may preferably be thirty times the frame time period, representing a half of a minute.

The report 180 may preferably include a waveform event list 150 for the waveform characteristics observed by the wireless vehicular sensor node 500 during the current and/or most recent meta-frame as shown in FIG. 17B. A waveform characteristic 120 may be represented in the waveform event list by a waveform event entry 152 including the following. A presence-flag 154 indicating the presence or absence of the vehicle 6. A frame-count 156 indicating the frame in the meta-frame, and a time-stamp 158 indicating the time slot within that frame in which the waveform characteristic occurred.

The waveform event list 150 may include a fixed number N of instances of the waveform event entry 152, to minimize computing and power consumption at the wireless vehicular sensor node 500. The fixed number N may be a power of two, such as 32 or 64.

The presence-flag 154 may represent a vehicle 6 being present with the binary value '1', and the absence of the vehicle with a '0'. Alternatively, '0' may represent the presence of the vehicle. And its absence by '1'.

The frame-count 156 may be represented in a five bit field. The time-stamp 158 may be represented in a ten bit field.

The waveform event entry may be considered as a fixed point number, preferably 16 bits. When the waveform event entry has one of the values of 0x7FFF or 0xFFFF, it represents a non-event, no additional waveform characteristic 120 has been determined by the wireless vehicular sensor node.

The access point 1500 may be a base station communicating with at least one of the first wireless vehicular sensor node 500-1 and the second wireless vehicular sensor node 500-1.

The preceding discussion serves to provide examples of the embodiments and is not meant to constrain the scope of the following claims.

What is claimed is:

1. A method comprising the step of counting the passing of vehicles between a first and a second wireless vehicular sensor nodes by operating an apparatus that interacts with a first filtered queue and a second filtered queue, with said first filtered queue created in response to a report based upon a magnetic sensor from said first wireless vehicular sensor node, with said second filtered queue created in response to a second report based upon a second of said magnetic sensor from said second wireless vehicular sensor node, and said apparatus distinct from said first wireless vehicular sensor node and from said second wireless vehicular sensor node;

wherein the step of counting, comprises said apparatus performing the steps of:

first determining (3300A) if either of said filtered queues are empty;

filling and filtering (3000) out short spikes less than a holdover interval of not more than 300 milliseconds (ms) in said waveform queues by using said reports received from said wireless vehicular sensor nodes;

finding (3100) a first rising edge in said filtered queues and designates said filtered queue as a first waveform;

second determining (3200) whether a second waveform rises before said first waveform falls;

third determining (3400) whether said second waveform falls before said first waveform falls;

causing (2500) a count;

fourth determining (3300B) if either of said filtered queues are empty;

first pushing (3500) only a last pulse back on each waveform queue;

fifth determining (3600) whether said second waveform starts within a first time T1 of said first waveform falling;

second pushing (3800) a most recent pulse back onto said second waveform queue; and sixth determining (3700) whether said second waveform falls after the next rise of said first waveform.

2. The method of claim 1, wherein the step filling and filtering (3000) further comprises the steps of:

repeating receiving said response from said wireless vehicular sensor node to update said filtered queue until all of said filtered queues are determined nonempty.

3. The method of claim 2, wherein the step of counting by said member of said processor group further comprises said member of said processor group performing the step of determining that all of said filtered queues are determined nonempty, is further comprised of the steps of:

determining if first filtered queue is nonempty; and determining if said second filtered queue is nonempty.

4. The method of claim 1, the step of finding (3100) further comprises the steps of:

finding first of said rising edges from said first filtered queue;

finding second of said rising edges from said second filtered queue;

comparing said first rising edge and said second rising edge to determine said first waveform and said second waveform;

popping a first pulse from one of said filtered queue to said first waveform; and popping said first pulse from said other of said filtered queue to said second waveform.

5. The method of claim 1, the step of second determining (3200) further comprises the steps of:

popping said pulse into said first waveform;

popping said pulse into second waveform; and determining whether said second waveform rise before said first waveform falls.

6. The method of claim 1, the step of fifth determining (3600) further comprises the steps of:

popping said pulse into said second waveform; and determining whether said second waveform starts within said first time T1 of said first waveform falling.

7. The method of claim 1, the step of sixth determining (3700), further comprises the steps of:

looking at a top pulse in said filtered queue for said first waveform;

determining whether said second waveform falls after the rise of said top pulse.

8. The method of claim 1, wherein at least one of said wireless vehicular sensor nodes uses a method of generating said report based upon at least one member of the group consisting of: a rising edge and a falling edge; wherein said members are determined based upon a vehicle sensor state using said magnetic sensor.

9. The method of claim 1, wherein at least one of said wireless vehicular sensor nodes uses a method of generating said report based upon a first time and an ending time using the recent variance of a vehicular sensor waveform based upon a vehicle sensor state using said magnetic sensor.

10. An apparatus, comprising said apparatus configured to count the passing of vehicles between a first and a second wireless vehicular sensor node by interacting with a first filtered queue and a second filtered queue, comprising:

means for first determining (3300A) if either of said filtered queues are empty;

means for filling and filtering (3000) out short spikes in empty waveform queues by using reports received from said wireless vehicular sensor nodes;

means for finding (3100) said first rising edge in said filtered queues and designating said filtered queue as a first waveform;

means for second determining (3200) whether a second waveform rises before said first waveform falls;

means for third determining (3400) whether said second waveform falls before the first waveform falls;

means for causing (2500) a good count;

means for fourth determining (3300B) if either of said filtered queues are empty;

means for first pushing (3500) only a last pulse back on each waveform queue;

means for fifth determining (3600) whether said second waveform starts within a first time T1 of said first waveform falling;

means for second pushing (3800) a most recent pulse back onto said second waveform queue; and means for sixth determining (3700) whether said second waveform falls after the next rise of said first waveform.

11. The apparatus of claim 10, further comprising:

said means for receiving said reports from said wireless vehicular sensor nodes.

12. The apparatus of claim 11, further comprising:

a processor configured for a wireline communicatively coupling (2062) to said means for receiving said reports from said wireless vehicular sensor nodes to implement the step for counting.

13. The apparatus of claim 10, wherein at least one member of a means group includes at least one instance of a member of the group consisting of: a finite state machine and a computer accessibly coupled to a memory and at least partly directed by a program system including at least one program step residing in said memory;

wherein said computer includes at least one data processor and at least one instruction processor;

wherein said means group consists of the members of:

said means for receiving, means for first determining (3300A), means for filling and filtering (3000), means for finding (3100), means for second determining (3200), means for third determining (3400), means for causing (2500), means for fourth determining (3300B), means for first pushing (3500), means for fifth determining (3600), means for second pushing (3800), and means for sixth determining (3700).

14. The apparatus of claim 13, wherein said program system further comprises at least one member of the group consisting of the program steps of:

first determining (3300A) if either of said filtered queues are empty;

filling and filtering (3000) out said short spikes in said empty waveform queues by using said reports received from said wireless vehicular sensor nodes;

finding (3100) said first rising edge in said filtered queues and designating said filtered queue as said first waveform;

second determining (3200) whether said second waveform rises before first waveform falls;

third determining (3400) whether said second waveform falls before the first waveform falls;

causing (2500) said good count;

fourth determining (3300B) if either of said filtered queues are empty;

first pushing (3500) only said last pulse back on each waveform queue;

fifth determining (3600) whether said second waveform starts within said first time T1 of said first waveform falling;

second pushing (3800) said most recent pulse back onto said second waveform queue; and sixth determining (3700) whether said second waveform falls after the next rise of said first waveform.

15. A method of manufacturing said apparatus of claim 13, comprising the step of:

providing the members of said means group to said apparatus.

16. The apparatus as a product of the process of claim 15.

17. The apparatus of claim 10, including an access point configured to communicate with said wireless vehicular sensor nodes.

18. The access point of claim 17, comprising:

means for receiving said reports from said wireless vehicular sensor nodes.

19. The apparatus of claim 10, including a processor communicatively coupled to an access point configured to communicate with said wireless vehicular sensor nodes.

* * * * *